United States Patent [19]

Spriessler

[11] Patent Number: 4,643,146

[45] Date of Patent: Feb. 17, 1987

[54] APPARATUS FOR CONTROLLING THE ROTARY SPEED OF A DIESEL ENGINE FOR A HYDRAULIC EXCAVATOR OR THE LIKE

[75] Inventor: Heinz Spriessler, Senden, Fed. Rep. of Germany

[73] Assignee: Liebherr-Hydraulikbagger GmbH., Kirchdorf, Fed. Rep. of Germany

[21] Appl. No.: 561,794

[22] Filed: Dec. 15, 1983

[30] Foreign Application Priority Data

Jan. 4, 1983 [DE] Fed. Rep. of Germany ..... 3300151
Mar. 3, 1983 [DE] Fed. Rep. of Germany ..... 3307596

[51] Int. Cl.[4] ..... F02M 39/00

[52] U.S. Cl. ..... 123/357; 123/339; 123/385; 414/699

[58] Field of Search ..... 123/357-359, 123/339, 386, 385, 387; 414/699

[56] References Cited

U.S. PATENT DOCUMENTS 2,303,951 12/1942 Oswald ..... 123/385
2,986,291 5/1961 Schick ..... 414/699
3,148,790 9/1964 Ziskal ..... 414/699
3,414,136 12/1968 Moore ..... 414/5
4,262,642 4/1981 Sverdlin ..... 123/385
4,305,360 12/1981 Meyer ..... 123/339
4,373,850 2/1983 Durham ..... 123/386

*Primary Examiner*—Carl Stuart Miller
*Attorney, Agent, or Firm*—Morgan & Finnegan

[57] ABSTRACT

In a diesel for a hydraulic excavator or the like, the speed regulator of the injection pump is set by a lever which is pivoted by a piston-cylinder unit against the force of a return spring. Before or during operation under load, the piston-cylinder unit brings the setting lever to a preselected load position and, after terminating or interrupting operation under load, moves it to its idling position. At least one handle of the control levers for the hydraulically movable implements of the excavator is provided with a switch which, on first actuation, so operates a magnetic valve that the piston cylinder unit or the return spring moves the setting lever to the load position and, on being actuated again, returns the setting lever to the idling position.

7 Claims, 2 Drawing Figures

Figure 1:
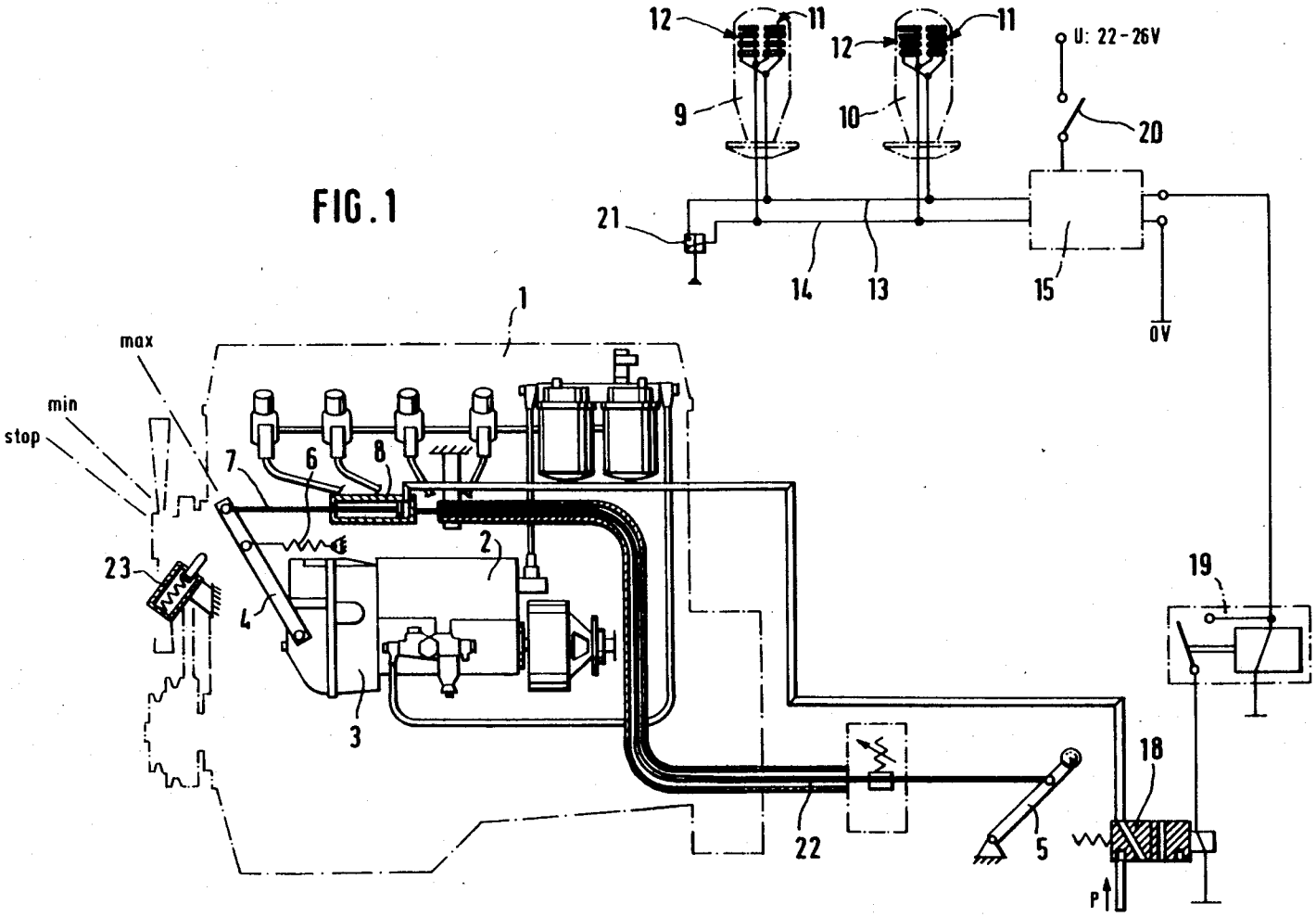

APPARATUS FOR CONTROLLING THE ROTARY SPEED OF A DIESEL ENGINE FOR A HYDRAULIC EXCAVATOR OR THE LIKE

The invention relates to an apparatus for controlling the rotary speed of a diesel engine for a hydraulic excavator or the like provided with control levers for the hydraulically movable implements, comprising a piston-cylinder unit which pivots the setting lever of the speed regulator of the injection pump against the force of a return spring and which, before or during operation under load, brings the setting lever to a preselected load position and, after termination or interruption of operation underload, moves it to its idling position.

In an apparatus of this kind known from DE-AS No. 25 02 221, the setting lever of the speed regulator is moved by a hydraulic piston-cylinder unit between its load and idling positions, the cylinder being so connected to the control circuit of the hydraulic system by way of conduits provided with check valves that, on actuation of the control levers for the implements, the piston is projected and swings the setting lever to its load position, the piston being biassed to the idling position of the setting lever by the return spring in the form of a compression spring so that, in the zero position of the control levers, at which the line feeding pressure fluid to the cylinder is relieved of pressure, the piston returns the setting lever to its idling position while discharging the hydraulic fluid in the cylinder through a throttle valve.

In another apparatus of the aforementioned kind known from the periodical 'Baumaschinen', Volume 10, 1982, page 13, the hydraulic circuit feeding compressed oil to the operating cylinders of the tools is provided with a pressure sensor which actuates the switch of a servo-system. By way of a magnetic valve, the servo-system exerts compressed air in such a way to a pneumatic cylinder with a spring-loaded piston that, upon the supply of compressed air, the piston swings the setting lever of the speed regulator to its idling position against the force of the return spring and, on venting of the cylinder, swings it to its load position.

The known apparatuses for controlling the rotary speed are comparatively expensive because the hydraulic circuits have to include valves or pressure sensors.

It is therefore the problem of the invention to provide a simpler apparatus for controlling the rotary speed.

According to the invention, this problem is solved in an apparatus of the aforementioned kind in that at least one handle of the control lever is provided with a switch which, on first actuation, so operates a magnetic valve that the piston-cylinder unit or the return spring moves the setting lever to the load position and, on being actuated again, returns it to the idling position.

Since the operator of the excavator has to grasp the handles of the control levers before operating the machine under load, he can easily move the setting lever to the preselected load position by actuating the switch. Similarly, before he releases the handles, he can operate the switches again to switch the motor to its idling position. The electric switches provided in accordance with the invention can be readily applied to the handles of the control levers and the means actuated thereby for adjusting the setting lever between its load and idling positions likewise call for only comparatively little expense.

Desirably, the switch consists of plates arranged in or on the handle surface and producing switching signals when touched by the hand. The plates form sensor faces, the switching signal being produced as a result of the transmission resistance of the hand. In this construction, the first switching signal is produced only after grasping the handle by hand whereas the second switching signal is produced when letting go.

Desirably, the switching signal actuating a relay is amplified by an amplifier and stabilized by a Schmitt trigger. However, the switching signals can also be processed in any other desired control circuits.

Preferably, the circuit of the magnetic valve actuating the piston-cylinder unit is retarded after the second actuation of the switch (or after letting the switch go) by a retarding circuit so that, after only a short load intermission, the engine speed is not decreased, which would give the impression of restless operating conditions. The time delay can amount up to ten seconds.

Other advantageous embodiments of the invention have been described in the subsidiary claims.

Figure 2:
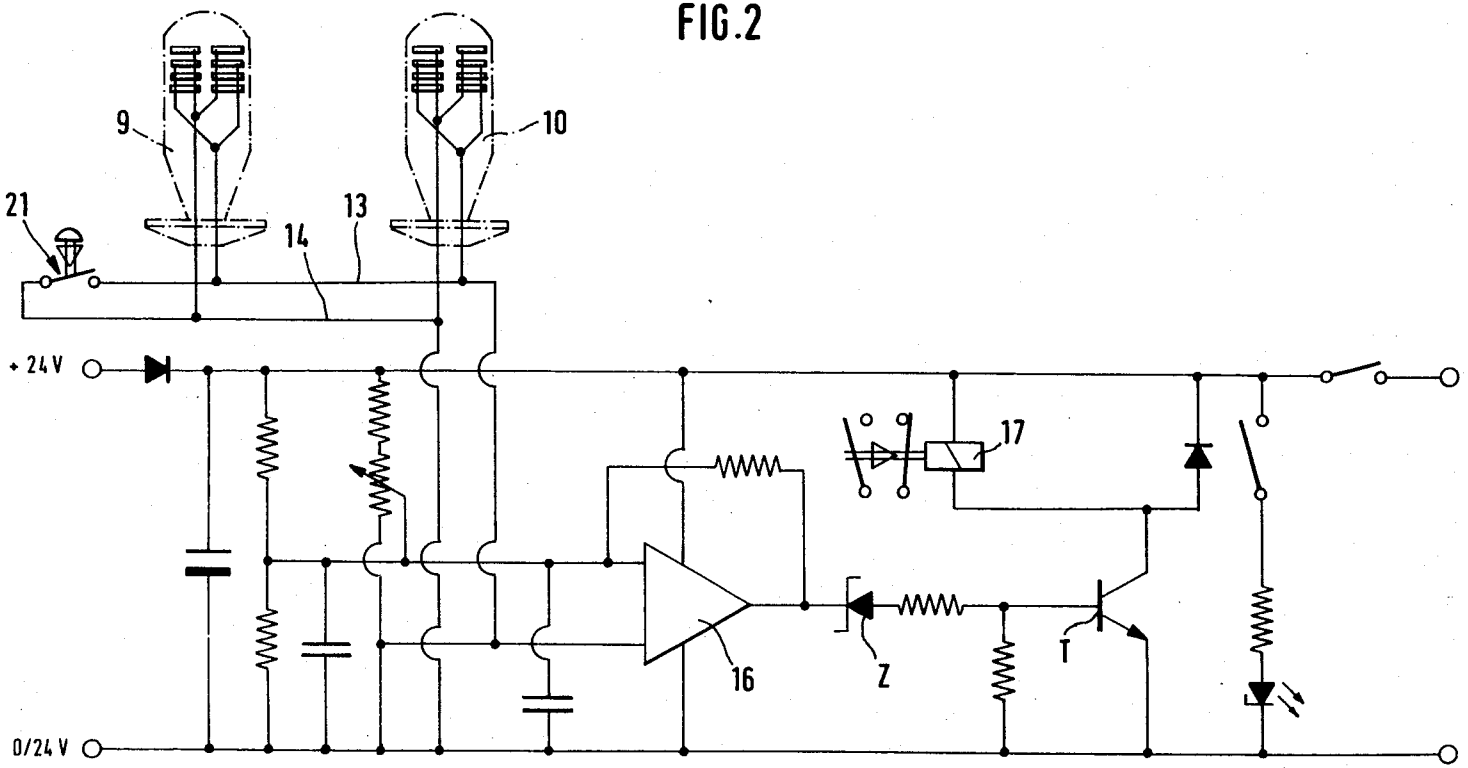

One example of the invention will be described in more detail with reference to the drawing, wherein:

FIG. 1 is a diagrammatic representation of the means controlling the rotary speed of a diesel engine, and FIG. 2 illustrates a circuit for amplifying the switching signals of the sensor switch.

The diesel engine 1 is provided with a series injection pump 2 regulated by the speed regulator 3. The latter is provided with a conventional setting lever 4 which can be adjusted from the stop position through the idling position up to the full load position. To preselect the desired load position of the setting lever 4, the piston-cylinder unit 8 is displaced by the preselection lever 5 by way of the Bowden cable 22. The setting lever 4 is subjected to a tension spring 6 in the direction of its load position. Thus, by way of the setting lever 4, the spring 6 seeks to retract the piston-cylinder unit 8, the retracted position corresponding to the preselected load position, usually the full load position.

Also pivoted to the setting lever 4 there is the piston rod 7 of the pneumatic cylinder 8. The cylinder of the piston-cylinder unit 8, preferably a pneumatic cylinder, is connected to the core of the Bowden cable 22 and displaceable by means of this core. The end of the cover of the Bowden cable 22 is mounted by way of a ball joint in a holder connected to the motor or to the injection pump housing. The setting force producible by the piston-cylinder unit 8 suffices to adjust the setting lever 4 but is less than the setting force required to turn the motor off. In the idling position, the setting lever 4 rests on the spring-mounted abutment 23 for idling. To enable the setting lever 4 to be brought to the stop position against the force of the spring of the abutment 23, the piston-cylinder unit 8 must be pressed to the stop position by way of the preselection lever 5.

The handles 9, 10 of the control lever of the operating implements have two groups of plates 11, 12 on their surface. These plates are connected by way of conduits 13, 14 to the electronic control mechanism 15. The groups of plates 11, 12 of each of the handles 9, 10 are connected to the lines 13, 14 in parallel.

The electronic control mechanism may consist of an amplifier 15 connected to a relay by way of a Schmitt trigger. Between the relay and the pneumatic magnetic valve 18 there is the time relay 19 which can be set to a retarding period of up to ten seconds. The electronic control mechanism 15 is activated by way of the switch 20 and supplied with current.

Another example of the circuit for a suitable electronic control mechanism is shown in FIG. 2. The signal produced by reason of the transmission resistances of the hand is amplified by the operational amplifier 16. As soon as the typical resistance or voltage value of the sensor switches for properly grasping the handles 9, 10 has been exceeded, the threshold voltage of the Zener diode Z is exceeded and the transistor T becomes conductive, so that the relay 17 is operated. If the switch K1 is closed in the illustrated manner, the pneumatic magnetic valve 18 is actuated.

If the excavator operator grasps the handles 9, 10 before operation under load takes place, the switching pulse causes the relay 17 to attract and, without any time delay caused by the time relay 19, operates the pneumatic magnetic valve 18 which vents the pneumatic cylinder 8 so that the return spring 6 moves the setting lever 4 to its load position.

If, after termination of operation under load, the operator of the excavator lets the handles 9, 10 go, the relay 17 drops off and, after its set retardation period, the time relay 19 operates the pneumatic magnetic valve 18 so that the latter feeds the pneuamtic cylinder 8 with compressed air and the setting lever 4 is swung to its idling position.

Parallel to the lines 13, 14 there is a microswitch 21 which, on actuation of the vehicle pedal, is operated so that, before movement takes place, the setting lever 4 is likewise moved to its load position.

I claim:

1. Apparatus for controlling the speed of a diesel engine for a hydraulic excavator or the like provided with control levers for the hydraulically movable implements, comprising a piston-cylinder unit which pivots the setting lever of the speed regulator of the injection pump against the force of a return spring and which, before or during operation under load, brings the setting lever to a preselected load position and, after termination of interruption of operation under load, moves it to its idling position, characterized in that at least one handle of the control levers is provided with a switch consisting of plates arranged in or on the surface of the handles and producing a switching signal through contact by the hand, said switching signal actuating a relay and being amplified by an amplifier and stabilized by a Schmitt trigger, said switch on its first actuation so operating a magnetic valve by way of an actuating circuit therefor which is connected to said switch and to said magnetic valve that the piston-cylinder unit or the return spring moves the setting lever to the load position and which, on being actuated again, returns it to the idling position, said actuating circuit including a delay circuit to retard the actuation of said piston-cylinder unit after the second actuation of said switch.

2. Apparatus for controlling the speed of a diesel engine for a hydraulic excavator or the like provided with control levers for the hydraulically movable implements, comprising a piston-cylinder unit which pivots the setting lever of the speed regulator of the injection pump against the force of a return spring and which, before or during operation under load, brings the setting lever to a preselected load position and, after termination of interruption of operation under load, moves it to its idling position, characterized in that at least one handle of the control levers is provided with a switch consisting of plates arranged in or on the surface of the handles and producing a switching signal through contact by the hand, said switching signal actuating a relay and being amplified by an amplifier and stabilized by a Schmitt trigger, said switch on its first actuation so operating a magnetic valve by way of an actuating circuit therefor which is connected to said switch and to said magnetic valve that the piston-cylinder unit or the return spring moves the setting lever to the load position and which, on being actuated again, returns it to the idling position, said actuating circuit including a delay circuit to retard the actuation of said piston-cylinder unit after the second actuation of said switch, said delay circuit providing a delay period of up to 10 seconds.

3. Apparatus for controlling the speed of a diesel engine for a hydraulic excavator or the like provided with control levers for the hydraulically movable implements, comprising a pneumatic piston-cylinder unit which pivots the setting lever of the speed regulator of the injection pump against the force of a return spring and which, before or during operation under load, brings the setting lever to a preselected load position and, after termination of interruption of operation under load, moves it to its idling position, characterized in that at least one handle of the control levers is provided with a switch consisting of plates arranged in or on the surface of the handles and producing a switching signal through contact by the hand, said switching signal actuating a relay and being amplified by an amplifier and stabilized by a Schmitt trigger, said switch on its first actuation so operating a magnetic valve by way of an actuating circuit therefor which is connected to said switch and to said magnetic valve that the pneumatic piston-cylinder unit or the return spring moves the setting lever to the load position and which, on being actuated again, returns it to the idling position, said actuating circuit including a delay circuit to retard the actuation of said pneumatic piston-cylinder unit after the second activation of said switch, said delay circuit providing a delay period of up to 10 seconds and said magnetic valve venting the pneumatic piston-cylinder unit on the first actuation of the switch and supplying it with compressed air after the second actuation.

4. Apparatus for controlling the speed of a diesel engine for a hydraulic excavator or the like provided with control levers for the hydraulically movable implements, comprising a piston-cylinder unit which pivots the setting lever of the speed regulator of the injection pump against the force of a return spring and which, before or during operation under load, brings the setting lever to a preselected load position and, after termination of interruption of operation under load, moves it to its idling position, characterized in that at least one handle of the control levers is provided with a switch consisting of plates arranged in or on the surface of the handles and producing a switching signal through contact by the hand, said switching signal actuating a relay and being amplified by an amplifier and stabilized by a Schmitt trigger, said switch on its first actuation so operating a magnetic valve by way of an actuating circuit therefor which is connected to said switch and to said magnetic valve that the piston-cylinder unit or the return spring moves the setting lever to the load position and which, on being actuated again, returns it to the idling position, said actuating circuit including a delay circuit to retard the actuation of said switch, said delay circuit providing a delay period of up to 10 seconds and said magnetic valve venting the piston-cylinder unit on the first actuation of the switch and supplying it with compressed air after the second actuation, said apparatus including a driving pedal having a microswitch associated therewith and which is arranged in parallel with the switches connected to the magnetic valve and the actuation of said driving pedal actuates said microswitch.

5. Apparatus for controlling the rotary speed of a diesel engine for a hydraulic excavator or the like provided with control levers for the hydraulically movable implements, comprising a piston-cylinder unit which pivots the setting lever of the speed regulator of the injection pump against the force of a return spring and which, before or during operation under load, brings the setting lever to a preselected load position and, after termination of interruption of operation under load, moves it to its idling position, characterized in that at least one handle of the control levers is provided with a switch which, on its first actuation, so operates a magnetic valve by way of an actuating circuit therefor connected to said switch and to said magnetic valve that the piston-cylinder unit or the return spring moves the setting lever to the load position and which, on being actuated again, returns it to the idling position.

6. Apparatus according to claim 5 characterised in that the switch consists of plates arranged in or on the surface of the handles and produces a switching signal through contact by the hand.

7. Apparatus according to claim 6, characterised in that the switching signal actuates a relay and is amplified by an amplifier and stabilized by a Schmitt trigger.

* * * * *